US005778287A

United States Patent [19]

Yu

[11] Patent Number: 5,778,287

[45] Date of Patent: Jul. 7, 1998

[54] ELECTROPHOTOGRAPHIC IMAGING APPARATUS HAVING AN IMPROVED BELT DRIVE SYSTEM

[75] Inventor: Robert C. U. Yu, Webster, N.Y.

[73] Assignee: Xerox Corporation, Stamford, Conn.

[21] Appl. No.: 786,542

[22] Filed: Jan. 21, 1997

[51] Int. Cl.[6] ..... G03G 15/00

[52] U.S. Cl. ..... 399/167; 399/162; 399/165; 474/149; 474/85

[58] Field of Search ..... 399/162, 165, 399/167; 198/833, 834; 474/149, 148, 150, 84, 85

[56] References Cited

U.S. PATENT DOCUMENTS

| | | | |
|---|---|---|---|
| 2,969,138 | 1/1961 | Sykokis | 198/834 X |
| 3,626,775 | 12/1971 | Gentry | 474/148 |
| 3,913,410 | 10/1975 | Ackerman | 474/84 X |
| 4,009,958 | 3/1977 | Kurita et al. | 399/165 |
| 4,050,575 | 9/1977 | Rossio | 198/834 |
| 4,070,919 | 1/1978 | Ummen et al. | 474/148 |
| 4,171,044 | 10/1979 | Rossio | 198/834 |
| 4,481,005 | 11/1984 | Mann, Jr. | 474/148 X |
| 4,627,702 | 12/1986 | Anderson | 198/835 X |
| 4,655,733 | 4/1987 | Jonason | 474/85 X |
| 4,942,958 | 7/1990 | Martilla | 198/833 |
| 5,174,437 | 12/1992 | Burger | 198/833 X |
| 5,261,527 | 11/1993 | Krismanth et al. | 198/833 |
| 5,262,826 | 11/1993 | Hediger | 399/167 |
| 5,410,389 | 4/1995 | Poehlein | 399/165 |
| 5,415,274 | 5/1995 | Krismanth et al. | 198/833 |
| 5,421,255 | 6/1995 | Kryk . | |

OTHER PUBLICATIONS

P.T.C. Bulletin; "Engineer Your V–Belt Drives for Lowest–Cost Operation"; Busacca, C.J., Rumble, F.H.; No. 152; Mar. 1951.

*Primary Examiner*—Matthew S. Smith

[57] ABSTRACT

An electrophotographic imaging apparatus including at least a first rotatable belt support roller and a second rotatable belt support roller, each of the first and second rotatable belt support rollers having an imaginary axis parallel to and spaced from the other, a flexible electrophotographic imaging belt in contact with and supported by the first and second rotatable belt rollers, a belt driving device and at least one flexible non-stretchable drive belt extending from the belt driving device directly to each of the belt support rollers whereby activation of the belt driving device applies a pushing force directly to the drive belt in the region between the drive belt driving device and the first rotatable belt roller and simultaneously applies pulling force directly to the drive belt in the region between the driving device and the second rotatable belt support roller.

13 Claims, 5 Drawing Sheets

ELECTROPHOTOGRAPHIC IMAGING APPARATUS HAVING AN IMPROVED BELT DRIVE SYSTEM

BACKGROUND OF THE INVENTION

The present invention relates in general to electrophotographic engine and more specifically, to an improved electrophotographic imaging apparatus having multiple driven support rollers to enhance its frictional contact with a flexible electrophotographic imaging member belt for precision belt transporting efficiency.

In the art of electrophotography, a typical copier, duplicator or printer comprises a flexible electrophotographic imaging member belt mounted around at least one rotatable belt support roller and a drive roller during image cycling. The electrophotographic imaging belt comprises a photoconductive insulating layer on a conductive layer. This imaging belt is imaged by first electrostatically charging the surface of the photoconductive insulating layer to form a uniform deposited charge and then exposing the charged belt to a pattern of activating electromagnetic radiation to form an electrostatic latent image. This electrostatic latent image may then be developed to form a visible image by depositing finely divided electrostatically attractable toner particles on the surface of the photoconductive insulating layer in image configuration. The resulting visible toner image can be transferred to a suitable receiving member such as paper. This imaging process may be repeated many times with reusable photoconductive insulating layers.

Flexible electrophotographic imaging member belts are usually multilayered photoreceptors that comprise a substrate, an electrically conductive layer, an optional hole blocking layer, an adhesive layer, a charge generating layer, a charge transport layer, an optional overcoating layer and an optional anticurl backing layer.

One type of popular photoreceptor is a flexible belt photoreceptor which comprises a thin metal coating ground layer over a flexible polymeric substrate support and two electrically active layers, including a charge generating layer and a charge transport layer. The electrically conductive ground layer may be formed, for example, on a flexible biaxially oriented substrate by a suitable coating technique such as vacuum deposition of metals. After formation of an electrically conductive ground plane, a hole blocking layer may be applied thereto. In some cases, an intermediate layer between the charge blocking layer and the adjacent generator layer may be used in the photoreceptor to improve adhesion or to act as an electrical barrier layer.

As more advanced, higher speed multi-colored electrophotographic copiers, duplicators and printers utilizing a flexible photoreceptor belt supported by a belt module are developed, more stringent photoreceptor functional requirements are needed to ensure superior imaging results. For example, uniform belt transporting speed is crucially important to achieve good copy print quality, particularly for multiple pass and single pass multicolor electrophotographic copiers, duplicators or printers. In a typical fullcolor, multiple pass electrophotographic copier, duplicator or printer, an electrostatic latent image is first created on the photoreceptor belt surface by the usual charging and exposure processes followed by development using sequential application of toner particles of each of the three primary colors during each belt revolution to cumulatively create a full color printed copy. As the electrophotographic copiers, duplicators and printers capable of producing full color image prints become the preferential choice for general use, it is common to find single pass designs in which toners of the various primary colors are sequentially accumulated over the latent image on the photoreceptor surface to form and develop into full color image prints. In the full color single pass design, four separate development stations are provided which comprise the three primary color separations along with a black. These stations are positioned along the path of a moving photoreceptor belt. As the belt advances to each development station, the photoreceptor surface is charged and exposed in areas thereof corresponding to the requirements of the particular separated primary color component of the full colored image to be printed. For example, along the process path immediately prior to the magenta development, the photoreceptor is charged and the areas corresponding to the magenta regions of the final full color image are exposed by a suitable means such as, for example, a laser beam of a raster output scanner (ROS) or a light emitting diode (LED) array print-bar. In similar manner, just before the cyan, yellow, or black development stations, the photoreceptor is recharged and exposed to form patterns corresponding to the color components in the full color image being printed.

To achieve the high quality full color print, the electrophotographic imaging machines are conveniently fitted with a backer bar to the backside of the photoreceptor belt directly opposite each development station to provide the photoreceptor surface flatness needed to effect uniform charging/toner deposition for superior full color development. Although the backer bars have a low friction surface intended to facilitate photoreceptor belt transport during electrophotographic imaging processes, the belt/bar sliding action, nonetheless, has been found to create substantial added drag force causing photoreceptor belt slippage on the drive roller thereby adversely affecting the quality of full color image printout. Moreover, photoreceptor belt slippage on the drive roller causes a serious wear problem on the backside of the photoreceptor belt and the outer surface of the drive roller as well. Photoreceptor belt and drive roll wear can generate debris and dust which affects the overall electrophotographic imaging functions such as electrical charging, quality toner image formation, and photoreceptor surface cleaning. In addition, the photoreceptor belt wear due to frictional belt/drive roller slippage decreases the anticurl back coating thickness which causes the photoreceptor belt to exhibit an upward curling along each edge to thereby affect charging uniformity and adversely impact toner image quality in copy printout. To resolve this belt slippage problem, attempts have been made to increase the applied photoreceptor belt tension to generate enhanced belt/drive roller friction to achieve more effective belt driving and good belt motion quality. However, it has been found that increasing the applied photoreceptor belt tension produces undesirable excessive belt creep. Photoreceptor belt creep relative to time causes continual belt stretching in the direction of belt motion resulting in belt dimensional elongation which exacerbates the effect of fatigue induced photoreceptor charge transport layer cracking during dynamic belt machine cycling and thereby shortening the belt service life. An alternative approach to prevent the photoreceptor belt slippage problem as disclosed in U.S. Pat. No. 5,421,255 is to add an elastic belt which wraps around a drive roller and a second roller, allowing the drive roller to drive the photoreceptor belt and the second roller as well to effect belt transport. Since the drive roller is powered directly by an attached motor while the second roller is indirectly driven by the drive roller through an elastic connecting belt, this indirect power transfer mechanism exhibits a time delay which hinders efficient synchronization during driving of the photoreceptor belt.

While the above-described imaging copiers. or printers form electrophotographic images, there is an urgent need to resolve the photoreceptor belt synchronization problem, particularly for full color machine systems employing backer bars, to yield high image quality print out copy.

INFORMATION DISCLOSURE STATEMENT

U.S. Pat. No. 5,421,255 to Kryk, issued on Jun. 6, 1995—An electrostatic printer employing a photoconductive belt wrapped around multiple rollers is disclosed. A motor drives a first roller. An elastic belt is wrapped around the first roller and a second roller, allowing the first roller to drive the second roller.

SUMMARY OF THE INVENTION

It is, therefore, an object of the present invention to provide an improved electrophotographic imaging apparatus which overcomes the above-noted disadvantages.

It is yet another object of the present invention to provide an improved electrophotographic imaging apparatus which effects excellent synchronized photoreceptor belt transporting speed.

It is also an object of the present invention to provide an improved electrophotographic imaging apparatus which can accommodate low photoreceptor belt applied tension while preventing belt slippage.

It is still another object of the present invention to provide an improved electrophotographic imaging apparatus which exhibits no photoreceptor belt slippage during dynamic belt cycling.

It is still yet another object of the present invention to provide an electrophotographic imaging apparatus in which good photoreceptor belt motion quality is maintained.

It is a further object of the present invention to provide an improved electrophotographic imaging apparatus which avoids photoreceptor belt creep.

It is yet a further object of the present invention to provide an improved electrophotographic imaging apparatus which extends the service life of photoreceptor charge transport layers.

It is still a further object of the present invention to provide a photoconductive imaging apparatus which prevents photoreceptor belt anticurl back coating wear problems during dynamic belt cycling.

It is again another object of the present invention to provide an electrophotographic imaging apparatus capable of producing high quality full color copy printouts.

It is also an object of the present invention to provide an improved electrophotographic imaging member which overcomes the shortfalls of the prior art.

The foregoing objects and others are accomplished in accordance with this invention by providing an electrophotographic imaging apparatus comprising at least a first rotatable support roller and a second rotatable support roller, each of the first and second rotatable support rollers having an imaginary axis parallel to and spaced from the other, a flexible electrophotographic imaging belt in contact with and supported by the first and second rotatable rollers, a belt driving device and at least one flexible non-stretchable drive belt extending from the belt driving device directly to each of the support rollers whereby activation of the belt driving device applies a pushing force to the drive belt in the region between the drive belt driving device and the first rotatable roller and simultaneously applies a pulling force directly to the drive belt in the region between the driving device and the second rotatable support roller.

BRIEF DESCRIPTION OF THE DRAWINGS

The accompanying drawings illustrate embodiments of the present invention.

DESCRIPTION OF PREFERRED EMBODIMENTS

Figure 1:
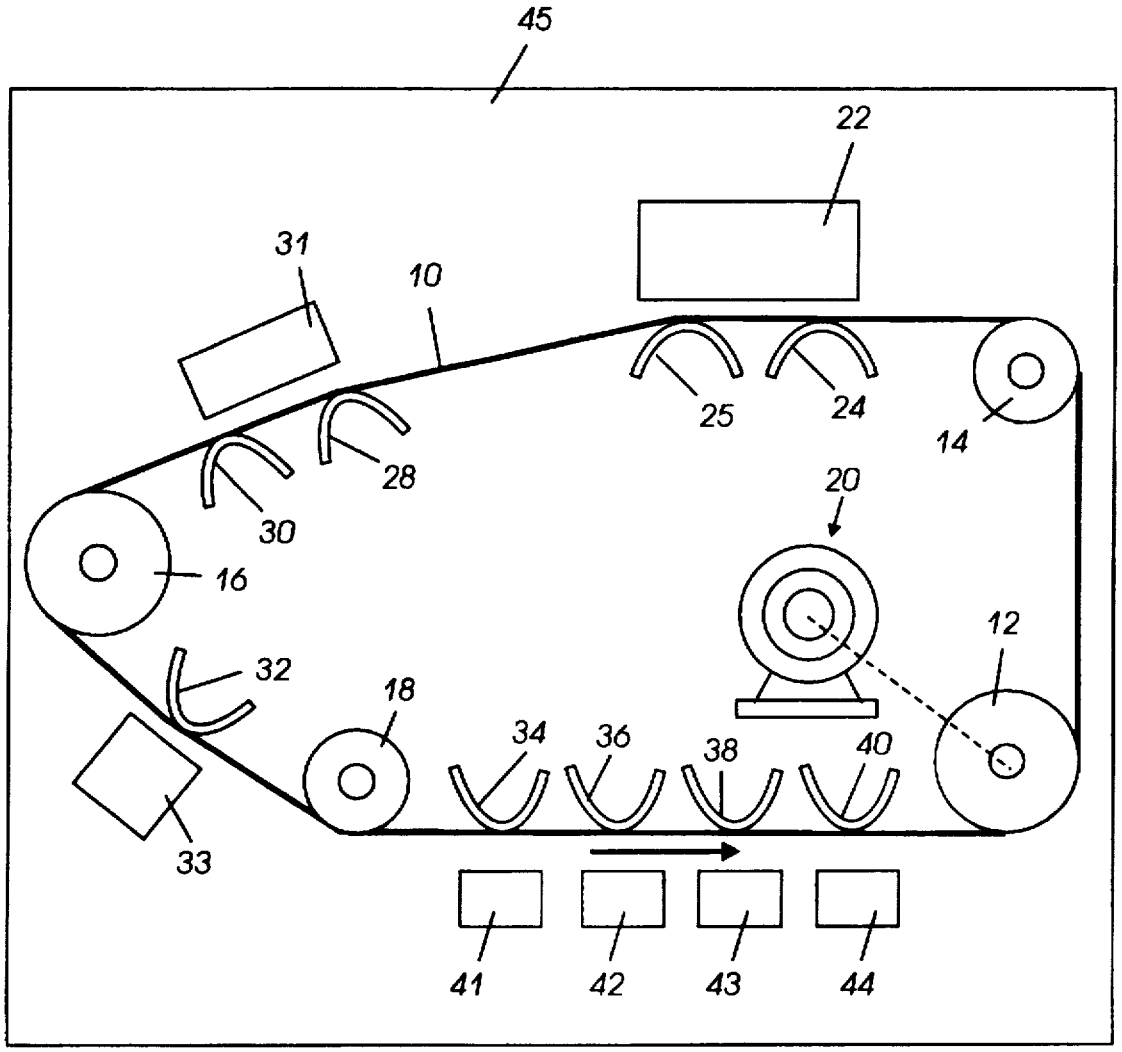
FIG. 1s a schematic representation of a typical electrophotographic imaging belt Mule design of prior art.

FIG. 1 is a side view of a prior art electrophotographic imaging belt module, used in a multiple pass full color system. A photoreceptor belt 10 is entrained about a drive roller 12, a stripper roller 14, a tension roller 16, and an encoder roller 18. The stripper roller 14, tension roller 16, and encoder roller 18 are mounted on a frame (not shown) so that they are freely rotatable. The tension roller 16 is supported on the frame by conventional spring loaded pivotable arms (not shown). Tension roller 16 provides a uniform force against the photoreceptor belt 10 to maintain desirable belt tension for proper electrophotogaphic imaging operations when the belt 10 is transported in the direction shown by the arrow. A motor 20 is connected by a conventional gear train to the drive roller 12 to provide the power needed to transport the photoreceptor belt 10. Cleaning station 22 removes toner residue from the photoreceptor belt 10 after each complete image copying process.

Backer bars 24 and 25 are employed at the cleaning station to improve cleaning efficiency. Backer bars 28 and 30 facilitate uniform electrical charging of the imaging surface of photoreceptor belt 10 by charging device 31. Backer bar 32 enhances imaging exposure by exposure device 33. Backer bars 34, 36, 38, and 40 are positioned at the backside of photoreceptor belt 10 opposite to the black and the three primary color stations 41, 42, 43 and 44, respectively, to ensure photoreceptor surface flatness for good toner image development. All of the illustrated components are directly or indirectly supported on a frame 45.

Figure 2:
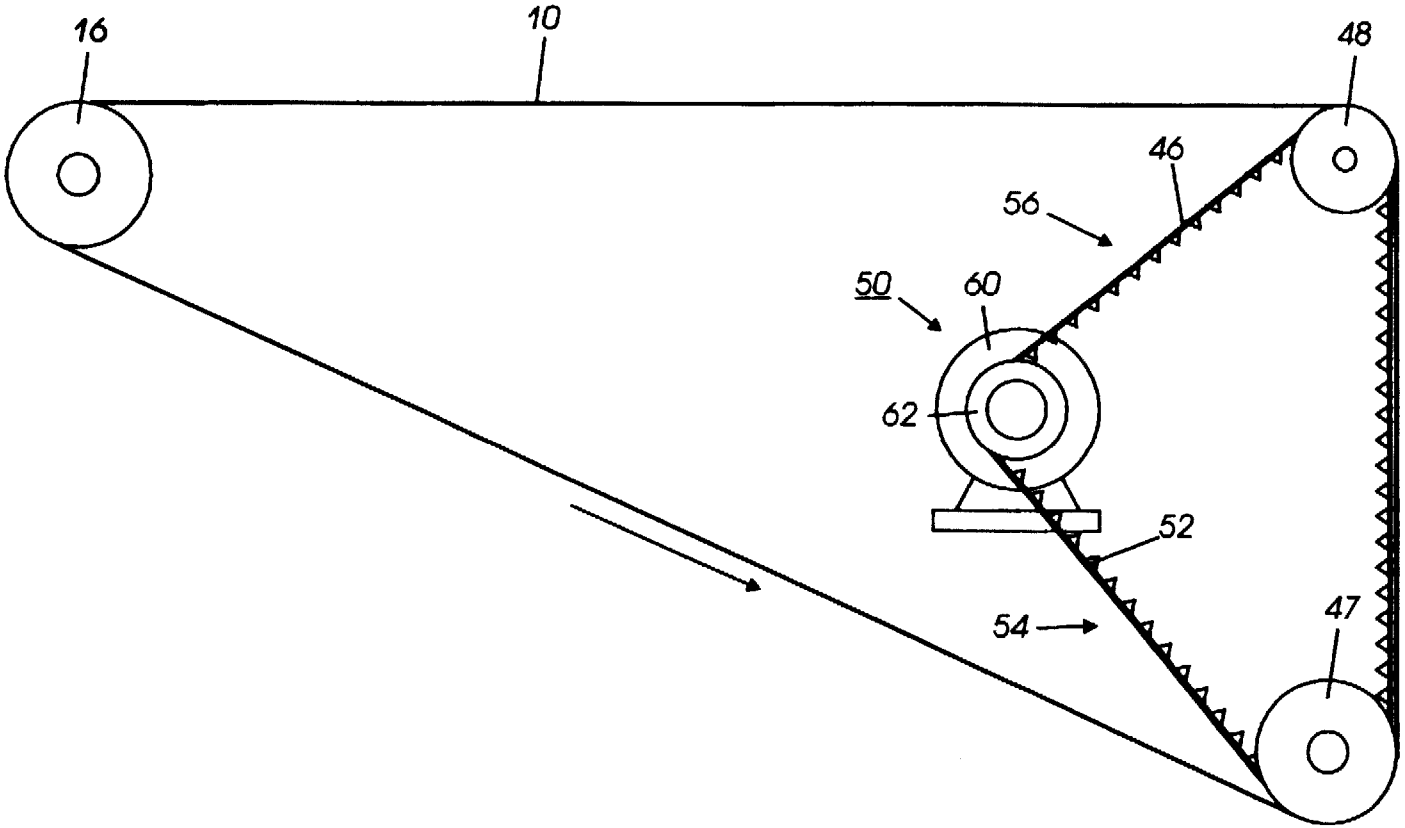
FIG. 2 is simplified depiction of the same belt module having the dual-drive system of this invention.

FIG. 2 illustrates a photoreceptor belt module design similar to that shown in FIG. 1 except that the drive system for the photoreceptor belt 10 has been modified to include a dual drive system of this invention. For the sake of simplicity, the encoder roller 18 and various backer bars and processing stations illustrated in FIG. 1 are not shown in FIG. 2. However, these components are contemplated as useful for the systems of this invention. The dual drive system utilizes a flexible, non-stretchable drive belt 46 to link both a first rotatable support roller 47 and a second rotatable support roller 48 (stripper roller in this embodiment) with a belt driving device 50 so that power generated by belt driving device 50 imparts driving power in a uniform and synchronized manner to photoreceptor belt 10. The flexible, non-stretchable drive belt 46 may be in the shape of.a notched or toothed belt with teeth 52 projecting from the inner surface of the belt. Any other suitable flexible, non-stretchable drive belt such as a Vbelt, belt with apertures, belt with depressions (all illustrated below) and the like may be used instead of the toothed drive belt 46. The first rotatable support roller 47 and second rotatable support roller 48 have imaginary axes parallel to each other. Flexible photoreceptor belt 10 is in contact with and supported by the first rotatable support roller 47, second rotatable support roller 48, and driven by the belt driving device 50. A frame (not shown) supports the support rollers and driving device as in FIG. 1. The flexible non-stretchable drive belt 46 extends from belt driving device 50 directly to each of the support rollers 47 and 48. Activation of belt driving device 50 applies a pushing force to drive belt 46 in the region 54 between the drive belt driving device 50 and first rotatable roller 47 and simultaneously applies a pulling force to drive belt 46 in the region 56 between driving device 50 and second rotatable support roller 48 which thereby creates a dual-drive mechanism to ease photoreceptor belt cyclic transport under a low applied belt tension. Belt driving device 50 comprises any suitable driving apparatus such as the electric motor 60 having a shaft to which is mounted a pulley 62. Pulley 62 has projections (not shown) which mesh into the spaces between teeth 52 of drive belt 46. Drive belt 46 should be flexible and non-stretchable. The expression "nonstretchable" as employed herein is defined as the drive belt 46 exhibits an undectectable elongation under the condition of delivering the push and pull driving forces to effect photoreceptor belt transport. It is important that the drive belt be capable of delivering a driving force to overcome at least 0.2 in-lb torque for effective photoreceptor belt transport without exhibiting appreciable drive belt stretching. Typically, the belts are fabricated from any suitable material such as natural or synthetic rubber reinforced with fibers filaments such as steel, glass fibers, nylon, Kevlar, meshed fabric, and the like to prevent stretching under the tension strain applied during image cycling. These non-stretchable belts generally have a cross section of between about 1.5 $cm^2$ and about 1.5 $cm^2$.

Figure 3:
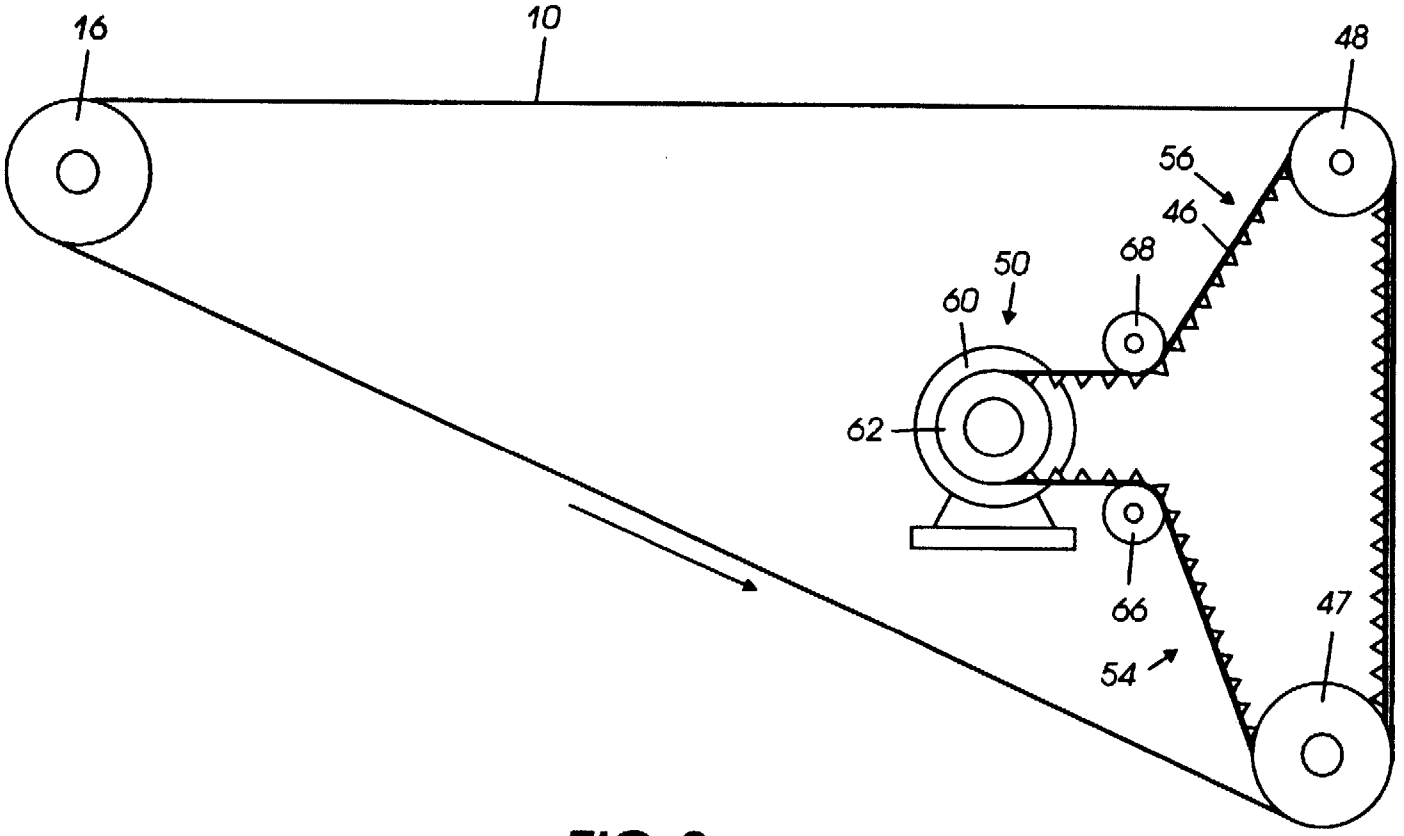
FIG. 3 illustrates a modified version of the belt module illustrated in FIG. 2.

FIG. 3 is the same photoreceptor belt module design shown in FIG. 2, except that the dual drive system is modified to include a first idler roll 66 which contacts the outer surface of drive belt 46 in the region 54 between drive belt driving device 50 and first rotatable roller 47 and a second idler roll 68 contacts the outer surface of drive belt 46 in the region 56 between said drive belt driving device 50 and second rotatable roller 48 to increase belt wrap around pulley 62 of drive belt driving motor 60 as well as around first rotatable roller 47 and second rotatable roller 48. This configuration further ensures that no slippage occurs between the drive belt 46 and the drive belt driving pulley 62, first rotatable roller 47 or second rotatable roller 48 when a flat (no notches or teeth) drive belt is utilized.

Figure 4:
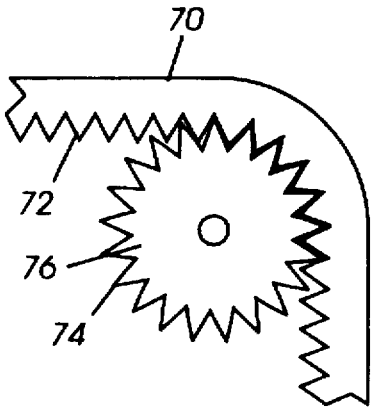
FIG. 4 (shows a schematic view of a drive belt having pointed teeth which mesh with teeth on a support roller or driving device.

FIG. 4 illustrates a drive belt 70 having projections such as pointed teeth 72 which mesh with the pointed teeth 74 on a drive wheel 76 attached to motor shaft of a drive belt driving device 50 shown in FIGS. 2 and 3 or to one end of a rotatable support roller such as first rotatable roller 47 or second rotatable roller 48 of a belt support module shown in FIGS. 2 and 3. When employed with a rotatable belt support roller, the drive wheel 76 may be secured to one end of the support roller or may actually be an integral part of the roller. When it is an integral part of a roller, it can be formed by machining, molding or other suitable technique.

Figure 5:
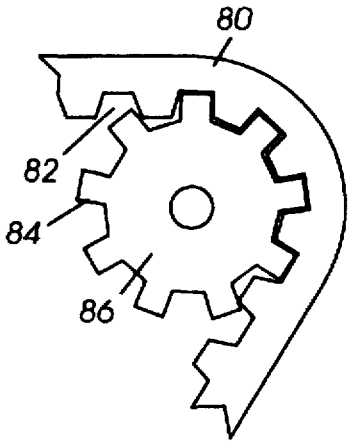
FIG. 5 illustrates a schematic view of a drive belt having rectangular depressions which mesh with rectangular teeth on a support roller or driving device.

FIG. 5 shows another embodiment of a drive belt 80 having rectangular shaped depressions 82 which mesh with rectangular teeth 84 on a drive wheel 86 attached to motor shaft of a drive belt driving device 50 shown in FIGS. 2 and 3 or to one end of a rotatable belt support roller such as first rotatable roller 47 or second rotatable roller 48 of a belt support module shown in FIGS. 2 and 3. When employed with a rotatable support roller, the drive wheel 86 may be secured to one end of the support roller or may actually be an integral part of the roller.

Figure 6:
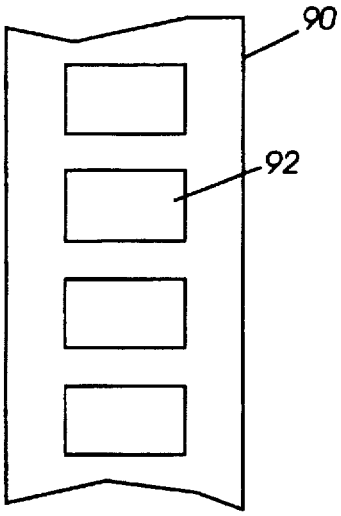
FIG. 6 shows a schematic view of a drive belt having rectangular depressions or openings.

FIG. 6 illustrates a drive belt 90 with apertures or depressions 92 having a rectangular shape. In the apertures embodiment, the apertures are holes that extend all of the way though the thickness of belt 90. In the depressions embodiment, the holes extend only part way through the thickness of belt 90. The depressions should be sufficiently deep to prevent slippage during functional cycling. The depth depends on the the drag on the photoreceptor belt, photoreceptor belt tension, and the like.

Figure 7:
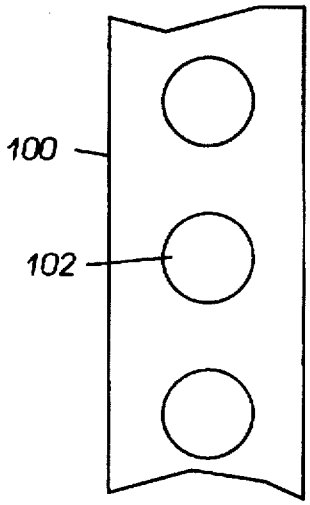
FIG. 7 illustrates a schematic view of a drive belt having circular depressions or openings.

FIG. 7 shows a drive belt 100 with apertures or depressions 102 having a circular shape. In the apertures embodiment, the apertures are holes that extend all of the way through the thickness of belt 100. In the depressions embodiment, the holes extend only part way through the thickness of belt 100. As with the embodiment shown in FIG. 6, the depressions should be sufficiently deep to prevent slippage during functional cycling.

Figure 8:
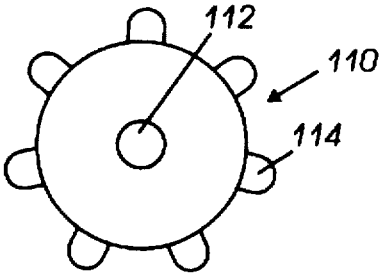
FIG. 8 shows a schematic view of a drive wheel having teeth which mesh with the circular depressions or openings of the drive belt illustrated in FIG. 7.

FIG. 8 illustrates a drive wheel 110 attached to motor shaft 112 of a drive belt driving device such as drive belt driving device 50 shown in FIGS. 2 and 3 or to one end of a rotatable belt support roller such as first rotatable roller 47 or second rotatable roller 48 of a belt support module shown in FIGS. 2 and 3. When employed with a rotatable support roller, the drive wheel 110 may be secured to one end of the support roller or may actually be an integral part of the roller. Blunt tipped projections 114 extend radially away from the axis of drive wheel 110 in a configuration similar to that of a sprocket. Projections 114 mesh with apertures or depressions in a drive belt such as apertures or depressions 102 of belt 100 shown in FIG. 7.

Figure 9:
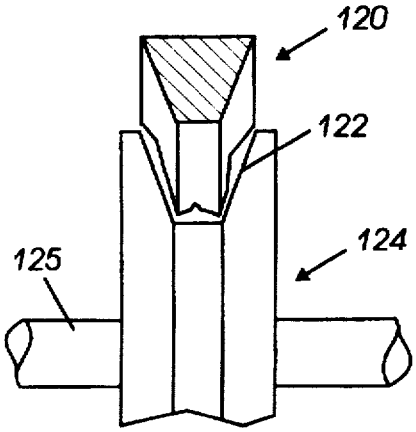
FIG. 9 illustrates a schematic view of a V-belt drive belt riding in the groove of a Pulley attached to a support roller or driving device.

In FIG. 9, a V-belt drive belt 120 is illustrated riding in a groove 122 of a pulley 124. Pulley 124 is attached to a shaft 125 which can be attached to a drive belt driving device 50 shown in FIGS. 2 and 3 or to one end of a rotatable belt support roller such as first rotatable roller 47 or second rotatable roller 48 of a belt support module shown in FIGS. 2 and 3. If desired, the pulley 124 can be directly secured to one end of a support roller instead of to a shaft as illustrated in FIG. 9 or a groove shaped like groove 122 may be formed in the outer. surface of one end of a support roller as an integral part of the roller. Since the contacting sides of belt 120 and groove 122 of pulley 124 are "V" shaped or tapered, the contact area between the contacting sides greatly increases the total contact area between belt 120 and groove 122 compared to a flat belt. This increased contact area prevents any slippage between these two surfaces.

Figure 10:
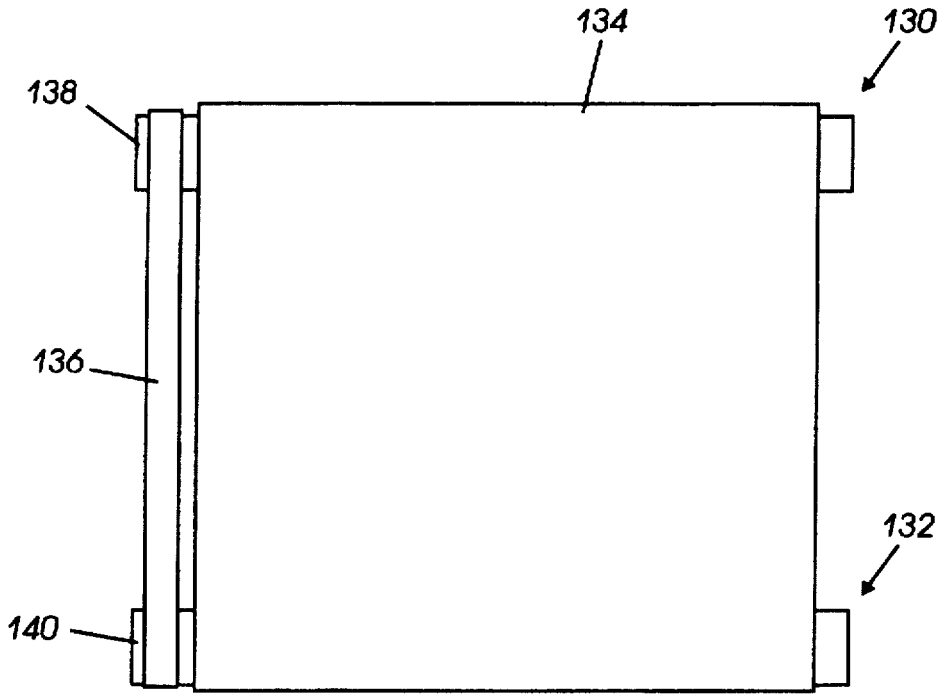
FIG. 10 shows a schematic view of two support rollers being driven by a drive belt contacting one end of each of the support rollers.

FIG. 10 shows an embodiment of this invention in which a first rotatable roller 130 and a second rotatable roller 132 support an electrophotographic imaging belt 134. A drive belt 136 is in contact with a first end 138 of first rotatable roller 130 and a first end 140 of second rotatable roller 132. Drive belt 136 is driven by any suitable drive belt driving device such as the belt driving devices shown in FIGS. 2 and 3. The width of electrophotographic imaging belt 134 is wider than the width of drive belt 136 because imaging belt 134 must have sufficient width to accommodate the width of the documents being produced.

Figure 11:
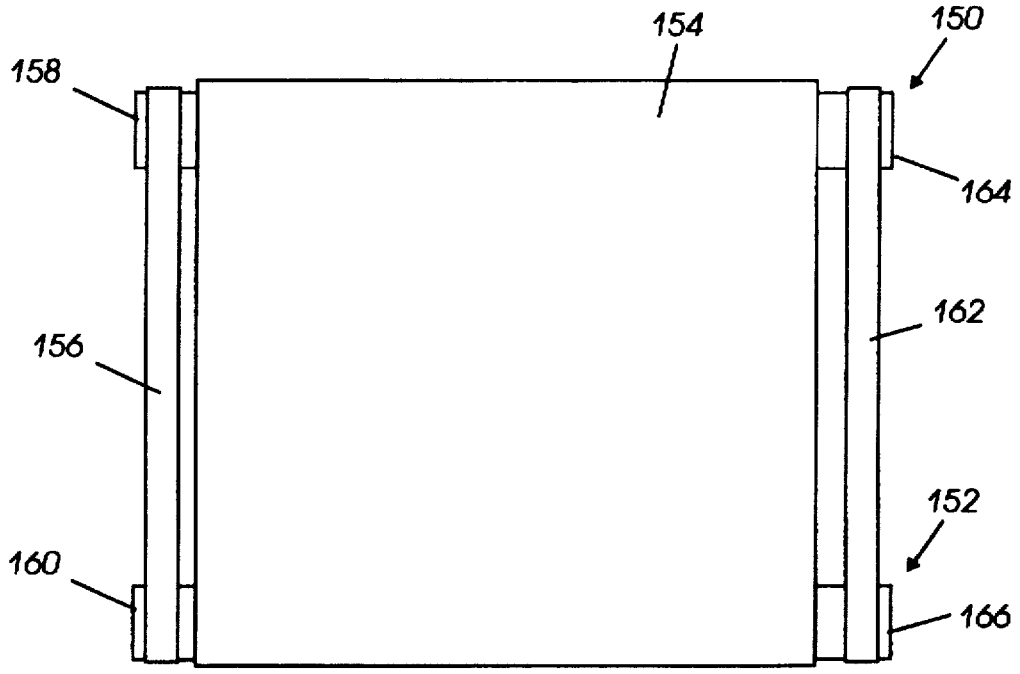
FIG. 11 shows a schematic view of two support rollers being driven by a first drive belt contacting one end of each of the support rollers and a second drive belt in contact with a second end of each of the support rollers.

FIG. 11 illustrates another embodiment of this invention in which a first rotatable roller 150 and a second rotatable roller 152 support an electrophotographic imaging belt 154. A drive belt 156 is in contact with a first end 158 of first rotatable roller 150 and a first end 160 of second rotatable roller 152. Drive belt 156 is driven by any suitable drive belt driving device such as the belt driving devices shown in FIGS. 2 and 3. A second drive belt 162 is in contact with a second end 164 of first rotatable roller 150 and with a second end 166 of second rotatable roller 152. Second drive belt 162 is driven by any suitable drive belt driving device such as the belt driving devices which drives first drive belt 156. If the same drive belt driving device is employed to drive both the first drive belt 156 and the second drive belt 162, the drive belt driving device may, for example, be an electric motor having a single shaft extending out of each end of the motor. Drive pulleys may be mounted on opposite ends of the shaft to drive belts 156 and 162.

In U.S. Pat. No. 5,421,255, a drive roller 120 is driven by an attached motor. When drive roller 120 starts to rotate, it will instantaneously drive a photoreceptor belt 110 as well as transmit torque to a stripper roller 114 which is still stationary. The initially transmitted torque from drive roller 120 (the stripper roller 114 has still not begun to rotate) will then gradually increase the pulling tension force of the connecting elastic belt 112 until a condition is reached where the tension force $T_2$ is greater than $T_1$ which, in this situation, is the moment that the difference in tension of the elastic belt 112 at the either side of the stripper roller 114 is capable of overcoming the moment of inertia of the stripper roller 114 plus the frictional resistance torque of the stripper roller 114 to set the stripper roller 114 into rotational motion. The time lag for the stripper roller 114 to respond, the delta time between the moment of initial drive roller 120 rotation and moment of initial stripper roller 114 rotation can be described by the mathematical equation given below:

$$t=MRV/2[R(T_2-T_1)-t_f]$$

wherein

R is the radius of the stripper roller 114, $T_2$ and $T_1$ are the elastic belt tension at either side of the stripper roller, $t_f$ is the inherent frictional resistant torque of the stripper roller, which is usually about 0.18 in-lb, M is the mass of the stripper roller, V is the desired photoreceptor belt transporting speed in inches per second, and t is the time lag in seconds between the moment of initial rotation of the drive roller and the moment of initial rotation of stripper the roller. It is important to note that when the drive roller 120 of the system described in U.S. Pat. No. 5,421,255 starts to rotate while the stripper roller 114 is still in a stationary condition, the photoreceptor belt 110 (which has a low mass) driven by the drive roller 120 will begin to rotate in synchronization with the drive roller 120. This will cause belt sliding over the stripper roller 114, resulting in wear of the back side of the photoreceptor belt 110. The sliding action of photoreceptor belt 110 over the stripper roller 114 also causes a localized photoreceptor belt 110 transporting speed variance which adversely affects the copy printout quality, particularly for full image on image color prints. The system of the present invention is totally free of this problem. In the system disclosed in U.S. Pat. No. 5,421,255 power is transferred to a first member in frictional contact with a substrate, the first member transfers power to the substrate and also transmits power to a second member in contact with the substrate, and the second member then transfers power to the substrate. Unlike the system disclosed in U.S. Pat. No. 5,421,255, the present invention simultaneously transfers power to a first member and second member and both the first member and second members simultaneously transfer power to to a substrate. The entire disclosure of U.S. Pat. No. 5,421,255 is incorporated herein by reference.

Additional advantages and modifications will readily occur to those having ordinary skill in the art. The invention in its broader aspects is therefore not limited to the specific details, representative apparatus, and illustrative examples shown and described. Thus, various modifications and variations can be made to the present invention without departing from the scope or spirit of the present invention, and it is intended that the present invention cover the modifications and variations provided they come within the scope of the appended claims and their equivalents.

What is claimed is:

1. An electrophotographic imaging apparatus comprising at least a first rotatable belt support roller and a second rotatable belt support roller, each of said first and second rotatable support rollers having an imaginary axis parallel to and spaced from the other, a flexible electrophotographic imaging belt in contact with and supported by said first and second rotatable rollers, a belt driving device and at least one flexible non-stretchable drive belt extending from said belt driving device directly to each of said support rollers whereby activation of said belt driving device applies a pushing force directly to said drive belt in the region between said drive belt driving device and said first rotatable roller and simultaneously applies pulling force directly to said drive belt in the region between said driving device and said second rotatable support roller and both said first rotatable roller and said second rotatable roller simultaneously apply force to said imaging belt.

2. An electrophotographic imaging apparatus according to claim 1 wherein said electrophotographic imaging belt is also in contact with and supported by a third rotatable roller having an imaginary axis parallel to and spaced from said imaginary axes of said first rotatable support roller and said second rotatable support roller.

3. An electrophotographic imaging apparatus according to claim 1 wherein said drive belt is in contact with a first end of each said support rollers.

4. An electrophotographic imaging apparatus according to claim 1 wherein a second drive belt is in contact with a second end of each said support rollers, said second drive belt adopted to be driven by said belt driving device.

5. An electrophotographic imaging apparatus according to claim 1 wherein said drive belt has an inner surface and an outer surface, a first idler roll contacts said outer surface of said drive belt in the region between said drive belt driving device and said first rotatable roller and a second idler roll contacts said outer surface of said drive belt in the region between said drive belt driving device and said second rotatable roller to increase belt wrap around said drive belt driving device and said rotatable belt support rollers.

6. An electrophotographic imaging apparatus according to claim 1 wherein each of said support rollers contains a V-shaped groove having sides and said drive belt is a V-belt having sides that form a V-shape, said sides of said drive belt contacting said sides of said groove of each of said support rollers.

7. An electrophotographic imaging apparatus according to claim 1 wherein said drive belt is a notched belt with notches.

8. An electrophotographic imaging apparatus according to claim 7 wherein said belt driving device, said first rotatable roller and said second rotatable roller comprise a contacting surface having projections which mesh with said notches in said notched belt.

9. An electrophotographic imaging apparatus according to claim 1 wherein said drive belt comprises spaced apertures or depressions.

10. An electrophotographic imaging apparatus according to claim 9 wherein said belt driving device, said first rotatable roller and said second rotatable roller, each including a contacting surface having projections which mesh with said apertures or depressions in said drive belt.

11. An electrophotographic imaging apparatus according to claim 9 wherein said apertures or depressions have a rectangular shape.

12. An electrophotographic imaging apparatus according to claim 9 wherein said apertures or depressions have a circular shape.

13. An electrophotographic imaging apparatus according to claim 1 including multiple color stations adjacent said electrophotographic imaging belt for depositing different colored images onto said electrophotographic imaging belt.

* * * * *